United States Patent [19]

Gebauer

[11] Patent Number: 4,767,476

[45] Date of Patent: Aug. 30, 1988

[54] METHOD OF AND DEVICE FOR STORING LIQUID EXPLOSIVES IN THE FORM OF AN EMULSION IN WATER

[75] Inventor: Hans-Jürgen Gebauer, Troisdorf, Fed. Rep. of Germany

[73] Assignee: Josef Meissner GmbH & Co., Cologne, Fed. Rep. of Germany

[21] Appl. No.: 128,137

[22] Filed: Dec. 3, 1987

[30] Foreign Application Priority Data

Dec. 3, 1986 [DE] Fed. Rep. of Germany ..... 3641207

[51] Int. Cl.[4] ..... D03D 23/00

[52] U.S. Cl. ..... 149/109.6; 149/2; 422/163

[58] Field of Search ..... 149/2, 109.6; 422/163

[56] References Cited

U.S. PATENT DOCUMENTS

| | | | |
|---|---|---|---|
| 3,984,249 | 10/1976 | Babcock et al. | 430/550 |
| 3,985,593 | 10/1976 | Machacek | 422/163 |
| 4,014,655 | 3/1977 | Brunnberg | 422/163 |
| 4,474,622 | 10/1984 | Forster | 252/153 |
| 4,500,369 | 2/1985 | Tag et al. | 149/2 |
| 4,555,278 | 11/1985 | Cescon et al. | 149/2 |
| 4,722,757 | 2/1988 | Cooper et al. | 149/2 |

*Primary Examiner*—Stephen J. Lechert, Jr.
*Attorney, Agent, or Firm*—Sprung Horn Kramer & Woods

[57] ABSTRACT

A container for the temporary storage of an emulsion of explosive and water consisting of two chambers that communicate through a gap at the floor and into which water is introduced into up to a prescribed level. One chamber of the container accommodates an agitator, and explosive or an emulsion of explosive and water is introduced into that chamber with constant circulation. The other chamber of the container has an opening at the bottom for removing emulsion that has been concentrated to a predetermined strength and has a water-supply line at the top.

12 Claims, 1 Drawing Sheet

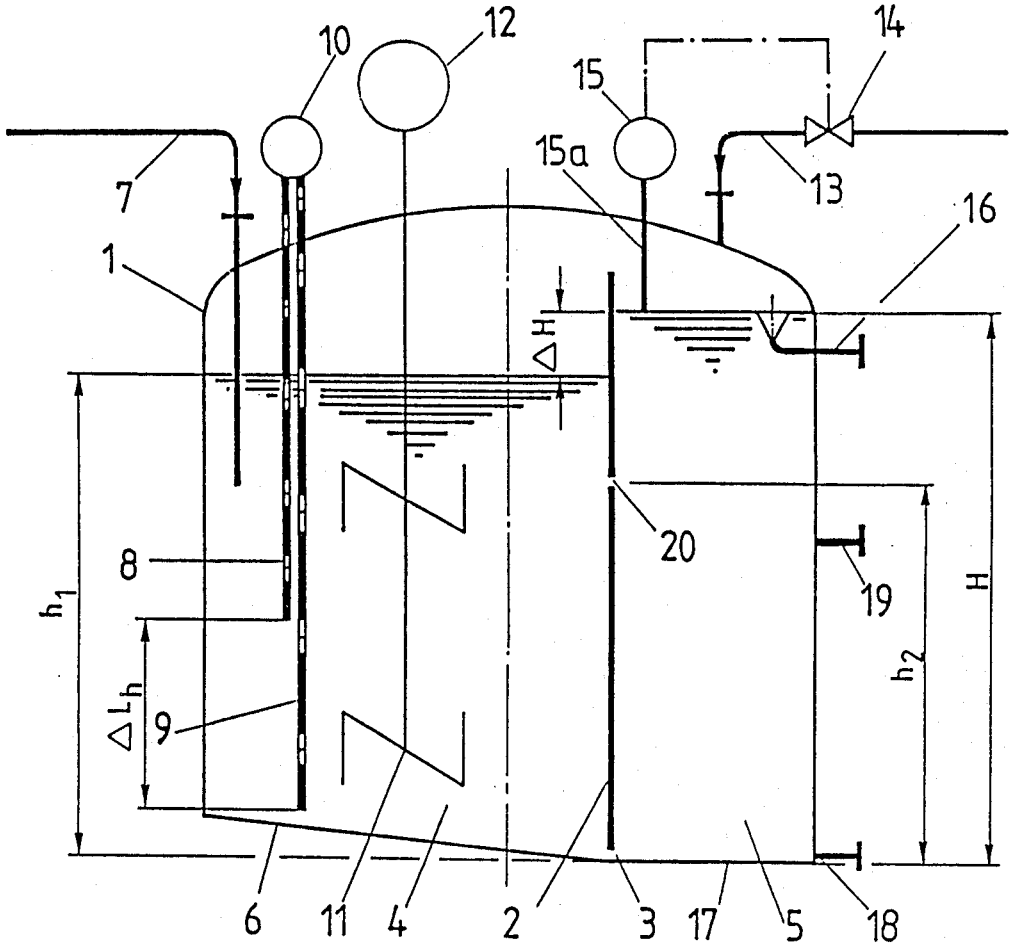
10
12
14
15
15a
13
7
16
1
ΔH
20
8
19
h1
H
h2
ΔLh
9
6
11
4
2
3
17
5
18

METHOD OF AND DEVICE FOR STORING LIQUID EXPLOSIVES IN THE FORM OF AN EMULSION IN WATER

BACKGROUND OF THE INVENTION

The present invention relates to a method of and a device for storing liquid explosives in the form of an emulsion in water.

Various methods of and devices for storing liquid explosives in the form of an aqueous emulsion are known. They feature equipment, a mechanical separator for instance, that removes the explosive from the emulsion for conveyance to the point of processing. One consequence is the presence in the separator of pure explosive, which is very hazardous to convey farther. Another drawback is that the separators cannot automatically adjust to different concentrations of emulsion, although it can be assumed that the proportion of explosive should decrease constantly.

These problems can of course be avoided by conveying the overall aqueous emulsion of explosive as is, although this entails considerable expenditure not only to convey the large amounts of water involved but also to separate the explosive from the emulsion at the site of delivery.

SUMMARY OF THE INVENTION

The object of the present invention is to eliminate not only the aforesaid hazard but also the expense involved in conveying unnecessarily large volumes of water and in separating the explosive at the site of delivery.

This object is attained in accordance with the invention by a method of storing and removing a liquid explosive in the form of an emulsion in water, comprising introducing water to a predetermined level into the two parts of a container which communicate with each other through a gap, one part constituting the emulsion end and the other part the concentration end, circulating water in the emulsion end of the container, introducing a predetermined amount of the explosive or of an emulsion of the explosive in water into the emulsion end, continuing the circulation of water until enough of the emulsion has concentrated to a prescribed level in the concentration end of the container, and removing concentrated emulsion from the concentration end in the vicinity of its floor while supplying an equal volume of (a) water to the concentration end and/or (b) an equal volume of explosive or of the emulsion of explosive in water to the emulsion end.

This is accomplished using a special device comprising a container (1) having a floor (6, 17), a partition (2) forming a gap (3) with the floor of the container and subdividing the container into an emulsion chamber (4) and a concentration chamber (5), an agitator (11) in the emulsion chamber, a line (7) for supplying explosive or an emulsion of explosive into the emulsion chamber, a line (13) for supplying water to the top of the concentration chamber, and a removal connection (18) at the floor of the concentration chamber.

The procedure in accordance with the invention results in an emulsion of explosive and water that is constantly available for conveying and that contains just enough water reliably to eliminate the hazard entailed by conveying without involving the double expenditure of excess water from which the explosive must later be separated. Communication between the emulsion end and the concentration end through the partition-to-floor gap maintains the system in a dynamic state, such that $$H \cdot \rho_w \cong h_1 \cdot \rho_E$$

wherein H is the level of the water in the concentration end, $h_1$ is the level of the emulsion in the emulsion end, and $\rho_w$ and $\rho_E$ are the density of the water and of the emulsion.

Depending on the intensity of circulation and optionally supported by a slight slope on the part of the floor of the emulsion end toward the partition-to-floor gap, which is appropriately dimensioned for that purpose, more or less of the emulsion with the higher density will flow through the gap into the bottom of the concentration end, which is kept full of stationary water. Since the liquid in the concentration end is not circulated, the higher-density explosive can increasingly settle in the water, meaning that the concentration of the emulsion will increase. This process will continue until the emulsion attains a concentration that is prescribed for the desired conditions.

If no already-concentrated emulsion of explosive and water is removed from the concentration end of the container, it will, due to its higher density, flow back into the emulsion end, where it will be emulsified again.

If on the other hand already concentrated emulsion is removed from the the concentration end, the process described above will continue.

The dynamics of the system can be improved even more if there are one or more openings—bores, slots, or similar structures for example—in the partition at a level $h_2$ below that of the liquid.

The level $h_1$ of the emulsion can then be defined from the static and from the dynamic component of the loss in flow through an opening at level $h_2$ as $$h_1 = \frac{H\rho_w}{\rho_E} + \frac{h_2\phi^2\left(1 - \frac{\rho_w}{\rho_E}\right)}{1 + \phi^2}$$

wherein $\phi$ is the coefficient of concentration at the opening or openings.

The rate of flow at the opening or openings will accordingly be $$w = \phi\sqrt{\frac{2gh_2}{1 + \phi^2}} \cdot \sqrt{\frac{\rho_E}{\rho_w} - 1}$$

Since the first root represents a constant at a given level $h_2$, the rate of flow will increase with the specific weight of the emulsion. Thus, when there is little explosive in the emulsion, little water will flow into the emulsion end through the opening or openings, and little of the emulsion will enter the concentration end through the partition-to-floor gap. This in turn implies that a thinner emulsion in the concentration end will have more time to concentrate than a thicker emulsion. Raising and lowering level $h_2$ will make it possible to control the slope of the increase in flow rate, and hence the concentration time, and to vary the amount flowing through the concentration end as desired in order to adjust to the desired conditions.

The value of the density in the emulsion end can be defined as ranging from 0 to 1, with 0 representing that of pure water and 1 that of pure explosive, in accordance with the formula $$\rho_E = \rho_w + \Delta Lh(\rho_{expl} - \rho_w)$$

wherein $\rho_{expl}$ and $\rho_w$ are the density of the pure explosive and of pure water and $\Delta Lh$ is the difference between the heights of the density sensors in the emulsion end.

The total amount $M_{expl}$ of explosive in the concentration end can then be derived from $$M_{expl} = area_E \cdot \Delta Lh \cdot h_1 \cdot \rho_{expl}$$

wherein $area_E$ is the cross-section of the emulsion end and the other expressions have the aforesaid meanings.

The invention is illustrated in the drawing which is a schematic view of a device in accordance with the invention.

Referring now more particularly to the drawing, a container 1 is divided into an emulsion end 4 and a concentration end 5 by a partition 2, leaving a gap 3 between the partition and the floor. The floor 6 of emulsion end 4 slopes gradually down toward partition-to-floor gap 3.

A line 7 that supplies explosive or an emulsion of explosive in water opens into emulsion end 4, which also contains two sensors 8 and 9 that are components of a density detector 10. Emulsion end 4 also accommodates a two-level agitator 11 that is driven in a known way by a schematically illustrated drive mechanism 12.

A line 13 that supplies a variable amount of water and is accordingly provided with a control valve 14 opens into concentration end 5. Concentration end 5 also accommodates level controls 15 and **15*a* and an overflow 16. The level controls are, as represented by the dot-and-dash line, functionally related to control valve 14. At the bottom of concentration end 5 and in the vicinity of its floor 17 is an outlet or connection 18 for removing concentrated emulsion. Concentration end 5 also has another connection 19**.

Partition 2 is provided with one or more openings 20 in the form of a circle, slot, or other appropriate shape.

Operation of the device will now be described. Water is introduced to a desired level into container 1 through line 13. Agitator 11 is turned on and explosive or an emulsion of explosive in water is introduced into emulsion end 4 through line 7. To prevent hydraulic shock to the explosive it is practical to increase the speed of agitator 11 slowly, over approximately 20 seconds for example, until it attains operating speed, and to establish an emulsion of explosive and water with a prescribed density in emulsion end 4.

Agitator 11 will force emulsion from emulsion end 4 into concentration end 5 through partition-to-floor gap 3. Since no circulation occurs in concentration end 5, the emulsion will be able to concentrate to the desired level as the explosive settles.

Once the desired concentration has been attained, the emulsion can be removed through connection 18 and conveyed forward for processing.

Connecting the aforesaid device through connections 18 and 19 to a device for conveying explosives as described in German Pat. No. 2 055 093 will create a system that always contains only emulsified explosive, so that already concentrated explosive can be supplied to a shipping injector at minimum risk with the used water being replaced subject to level controls 15 and **15*a* and the removed explosive as well, if desired, in the form of pure explosive or in that of an emulsion of explosive in water through line 7**, depending on whether the operation is batch-by-batch and discontinuous or continuous.

The situation illustrated in the drawing is only an example. Thus it may be desirable or necessary, depending on the type of explosive involved, to maintain a more or less dense emulsion in emulsion end 4 or a more or less high concentration in concentration end 5, in which case the parameters H, $h_1$, and $\Delta H$ will vary accordingly. The shape and capacity of container 1 and the ratio between the cross-sections of emulsion end 4 and concentration end 5 can of course also be varied in accordance with the prevailing conditions. Another variable of course is the parameter $\Delta Lh$, and the bottom of line 7 can be located elsewhere than as illustrated. The same is true of the location of connection 19 as long as it is positioned to ensure that concentration end 5 will always contain pure water when the device in accordance with the invention is connected to the device described in German Pat. No. 2 055 093. Connection 19 could accordingly also be positioned for instance above opening(s) 20.

Depending on the explosive involved and on the accordingly appropriate density of the emulsion in emulsion end 4 as well as on the concentration in concentration end 5, it can also be practical or necessary to vary the shape and area of partition-to-floor gap 3 or opening(s) 20.

Thus, gap 3 can extend either over the total width of container 1 or only over part of its width and to an appropriate height. It is also conceivable to distribute several slot-like gaps along the width of the container. In any case the gap will, independently of the capacity of the container, always be high enough to keep it from clogging due to the surface tension of the explosive.

Similar considerations also apply to opening(s) 20, which can be in the form of one or more slots or preferably in that of one or more round bores. It is, however, important for the overall cross-section of opening or openings 20 and the level $h_2$ that they are mounted at to be correctly calculated in relation to the prevailing or desired conditions.

It is important in relation to adaptation to different conditions, when for example different types of explosive are involved, to make it possible to vary the open cross-sections of partition-to-floor gap 3 and opening or openings 20.

Similar considerations also apply of course to the slope of the floor 6 of emulsion end 4 and to the cross-section of emulsion end 4 and of concentration end 5. The ratio will in any case always ensure a constantly unimpeded flow of emulsion into concentration end 5 from emulsion end 4 and vice versa, reliably preventing undesirable accumulations of explosive that would lead to hazardous concentrations.

The invention is particularly applicable to the transport and storing of explosives such as nitroglycerine, nitro-glycol, triethylene, glycol dinitrate and diethylene glycol dinitrate.

For example in the transport of an emulsion of 800 kg nitro-glycol in 1600 l water, which is introduced through line 7 satisfactory operation has been realized with a container 1 having a volume of 4000 l. The emulsion of the explosive and water was concentrated to a weight relation of 1:1, the density detector 10 showing 50%. The height of the partition 2 in this operation was 180 cm, the gap 3 2 cm and two holes 20 had a diameter of 1.5 cm. 300 l water per hour were introduced through line 13 and 500 kg nitro-glycol per hour removed through connection 18.

It is understood that the specification and examples are illustrative but not limitative of the present invention and that other embodiments within the spirit and scope of the invention will suggest themselves to those skilled in the art.

What is claimed is:

1. A method of storing and removing a liquid explosive in the form of an emulsion in water, comprising introducing water to a predetermined level into the two parts of a container which communicate with each other through a gap, one part constituting the emulsion end and the other part the concentration end, circulating water in the emulsion end of the container, introducing a predetermined amount of the explosive or of an emulsion of the explosive in water into the emulsion end, continuing the circulation of water until enough of the emulsion has concentrated to a prescribed level in the concentration end of the container, and removing concentrated emulsion from the concentration end in the vicinity of its floor while supplying an equal volume of (a) water to the concentration end and/or (b) an equal volume of explosive or of the emulsion of explosive in water to the emulsion end.

2. A method according to claim 1, wherein the parts of the container communicate through one or more additional openings located below the level of the liquid.

3. A method according to claim 2, wherein the cross-section of the means of communication is variable.

4. A method according to claim 1, wherein the cross-section of the gap is variable.

5. A method according to claim 1, wherein the floor of the emulsion end of the container slopes down gradually toward the gap.

6. A device for storing and removing a liquid explosive in the form of an emulsion in water comprising a container (1) having a floor (6, 17), a partition (2) forming a gap (3) with the floor of the container and subdividing the container into an emulsion chamber (4) and a concentration chamber (5), an agitator (11) in the emulsion chamber, a line (7) for supplying explosive or an emulsion of explosive into the emulsion chamber, a line (13) for supplying water to the top of the concentration chamber, and a removal connection (18) at the floor of the concentration chamber.

7. A device according to claim 6, wherein the partition (2) has at least one opening (20) at the top but below the particular level of liquid in chambers (4, 5) of the container.

8. A device according to claim 7, wherein the cross-section of at least one of the partition-to-floor gap (3) and of the opening (20) is variable.

9. A device according to claim 6, including means (8, 9, 10) in the emulsion chamber (4) for detecting differences in density, and level controls (15, 15*a*) in the concentration chamber (5).

10. A device according to claim 9, wherein the level controls (15, 15*a*) are operatively connected with the water-supply line (13).

11. A device according to claim 6, wherein the concentration end (5) is provided with a water overflow (16).

12. A device according to claim 6, wherein the floor (6) of the emulsion chamber (4) slopes gradually toward the partition-to-floor gap (3).

* * * * *